US012721391B1

(12) United States Patent
Kong

(10) Patent No.: US 12,721,391 B1
(45) Date of Patent: Sep. 1, 2026

(54) WIG CAP

(71) Applicant: Xuchang Weiken Hair Products Co., Ltd., Xuchang City (CN)

(72) Inventor: Xiangfeng Kong, Xuchang City (CN)

(73) Assignee: Xuchang Weiken Hair Products Co., Ltd., Xuchang City (CN)

( * ) Notice: Subject to any disclaimer, the term of this patent is extended or adjusted under 35 U.S.C. 154(b) by 0 days.

(21) Appl. No.: 19/399,943

(22) Filed: Nov. 25, 2025

(30) Foreign Application Priority Data

Nov. 10, 2025 (CN) ..... 202522384992.9

(51) Int. Cl.
*A41G 3/00* (2006.01)

(52) U.S. Cl.
CPC ..... *A41G 3/005* (2013.01); *A41G 3/0016* (2013.01); *A41G 3/0033* (2013.01)

(58) Field of Classification Search
None
See application file for complete search history.

(56) References Cited

U.S. PATENT DOCUMENTS 5,873,373 A * 2/1999 Narvick ..... A41G 3/005 132/54
2003/0116170 A1* 6/2003 Nicot ..... A41G 3/0016 132/53
2003/0131861 A1* 7/2003 Prestia ..... A41G 3/0008 132/53
2004/0139978 A1* 7/2004 Anzivino ..... A41G 3/0041 132/54
2006/0130863 A1* 6/2006 Chung ..... A41G 3/0041 132/54
2012/0186595 A1* 7/2012 Kimura ..... A45D 8/38 132/53
2014/0116456 A1* 5/2014 Palmer-Rogers .... A41G 3/0041 132/53
2016/0227863 A1* 8/2016 Nakajima ..... A41G 3/0016
2018/0055122 A1* 3/2018 Kim ..... A41G 3/0033
2019/0246728 A1* 8/2019 Chira ..... A41G 5/0073
2024/0148091 A1* 5/2024 Kong ..... A41G 3/0033
2024/0148092 A1* 5/2024 Ombres ..... A41G 3/0058

* cited by examiner

*Primary Examiner* — Tatiana L Nobrega

(57) ABSTRACT

A wig cap includes a first wearing portion, a second wearing portion and an adjusting portion. The first wearing portion is worn on a front portion of a head. The second wearing portion is worn on a rear portion of the head and is connected to the first wearing portion. The adjusting portion is respectively connected to the first wearing portion and the second wearing portion. The adjusting portion is configured for adjusting a tightness of the wig cap worn on the head. Through the above structure, the first wearing portion is worn on the front portion of the head. The second wearing portion is worn on the rear portion of the head. The adjusting portion can be adjusted according to a size of a user's head, so that the wig cap is attached to the user's head.

16 Claims, 9 Drawing Sheets

WIG CAP

CROSS-REFERENCE TO RELATED APPLICATIONS

The application claims priority of Chinese patent application CN2025223849929, filed on Nov. 10, 2025, which is incorporated herein by reference in its entirety.

TECHNICAL FIELD

The present invention relates to the field of wig cap, particularly to a wig cap.

BACKGROUND ART

The wig cap is a hair cap woven by an artificial chemical fiber wire. It is usually worn on a user's head as a decoration increasing the aesthetic appeal. However, the existing wig cap needs to be fixed to the head by glue. In this way, the wig cap cannot be detached at will, and the existing wig cap is not breathable for long-term wearing, with a poor user experience. At the same time, some existing wig caps are not attached to the head of the human body and are prone to falling off.

SUMMARY

In order to overcome the shortcomings of the prior art, the present invention provides a wig cap including a first wearing portion, a second wearing portion and an adjusting portion. The first wearing portion is worn on a front portion of a head.

The second wearing portion is worn on a rear portion of the head and is connected to the first wearing portion;

The adjusting portion is connected to the first wearing portion and the second wearing portion, respectively. The adjusting portion is configured for adjusting a tightness of the wig cap worn on the head.

As an improvement of the present invention, a first connecting strap is provided at a lower edge of the second wearing portion. The first connecting strap is arranged around the lower edge of the second wearing portion; and the first wearing portion is connected to the second wearing portion via the first connecting strap.

As an improvement of the present invention, the adjusting portion includes a first adjusting portion and a second adjusting portion. The first adjusting portion is spatially symmetric to the second adjusting portion. The first adjusting portion and the second adjusting portion are respectively connected to the second wearing portion through the first connecting strap.

As an improvement of the present invention, the first adjusting portion includes a first main body and a first adjusting structure. The first adjusting structure is arranged on the first main body. The first main body is provided with a second connecting strap. The first main body is connected to the second wearing portion through the first connecting strap. The first main body is connected to the first wearing portion through the second connecting strap.

As an improvement of the present invention, the first main body is further provided with a third connecting strap. The third connecting strap and the second connecting strap are arranged opposite to each other. The third connecting strap and the second connecting strap are arranged on two sides of the first main body. The first main body defines a first wearing cavity between the second connecting strap and the third connecting strap. The first wearing cavity defines a first opening at one end of the second connecting strap.

As an improvement of the present invention, the first adjusting structure includes a first elastic band and a plurality of first fasteners. The first elastic band is fastened to the first fastener. The plurality of first fasteners are arranged sequentially from top to bottom on the second connecting strap. The first elastic band includes a first band body and a first hook fastener. A first end of the first band body is arranged in the first wearing cavity and is connected to an inner wall of the first wearing cavity. A second end of the first band body is connected to the first hook fastener. The first hook fastener is arranged outside the first wearing cavity. The first hook fastener can be fastened to any one of the first fasteners.

As an improvement of the present invention, the second adjusting portion includes a second main body and a second adjusting structure. The second adjusting structure is arranged on the second main body. The second main body is provided with a fourth connecting strap. The second main body is connected to the second wearing portion through the first connecting strap. The second main body is connected to the first wearing portion through the fourth connecting strap.

As an improvement of the present invention, the second main body is further provided with a fifth connecting strap. The fifth connecting strap and the fourth connecting strap are arranged opposite to each other. The fifth connecting strap and the fourth connecting strap are arranged on two sides of the second main body. A second wearing cavity is defined between the fourth connecting strap and the fifth connecting strap on the second main body. The second wearing cavity defines a second opening at one end of the fourth connecting strap.

As an improvement of the present invention, the second adjusting structure includes a second elastic band and a plurality of second fasteners. The second elastic band is fastened to the second fastener. The plurality of second fasteners are arranged sequentially from top to bottom on the fourth connecting strap. The second elastic band includes a second band body and a second hook fastener. A first end of the second band body is arranged in the second wearing cavity and is connected to an inner wall of the second wearing cavity. A second end of the second band body is connected to the second hook fastener. The second hook fastener is arranged outside the second wearing cavity. The second hook fastener can be fastened to any one of the second fasteners.

As an improvement of the present invention, the first connecting strap is provided with a first inserting comb module at the first main body. The first inserting comb module includes a first inserting comb and a plurality of first fixing members. The plurality of first fixing members are sequentially arranged on the first connecting strap. Each first fixing member defines a first through hole. The first inserting comb includes a plurality of first comb teeth. One end of the first comb teeth passes through the first through hole and is inserted into the first fixing member.

As an improvement of the present invention, the first connecting strap is provided with a second inserting comb module at the second main body. The second inserting comb module includes a second inserting comb and a plurality of second fixing members. The plurality of second fixing members are sequentially arranged on the first connecting strap. Each second fixing member is provided with a second through hole. The second inserting comb includes a plurality of second comb teeth. One end of the second comb teeth passes through the second through hole and is inserted into the second fixing member.

As an improvement of the present invention, the wig cap further includes a third wearing portion. The third wearing portion is positioned on one side of the second wearing portion. The third wearing portion includes a first end, a second end and a third end. The first end of the third wearing portion is connected to the first connecting strap. The second end of the third wearing portion is connected to the third connecting strap. The third end of the third wearing portion is connected to the fifth connecting strap.

As an improvement of the present invention, the first connecting strap is provided with a third inserting comb module at the third wearing portion. The third inserting comb module includes a third inserting comb and a plurality of third fixing members. The plurality of third fixing members are sequentially arranged on the first connecting strap. A third through hole is defined on each third fixing member. The third inserting comb includes a plurality of third comb teeth, and one end of the third comb teeth passes through the third through hole and is inserted into the third fixing member.

As an improvement of the present invention, the first wearing portion and the second wearing portion both define first mesh holes. The first mesh holes includes a first mesh hole unit and a second mesh hole unit. The first mesh hole unit is arranged on the first wearing portion. The second mesh hole unit is arranged on the second wearing portion. An aperture size of the first mesh hole unit is greater than an aperture size of the second mesh hole unit.

As an improvement of the present disclosure, the first adjusting portion, the second adjusting portion, and the third wearing portion all define second mesh holes. The second mesh holes includes a third mesh hole unit and a fourth holes mesh unit. The third mesh hole unit is arranged on the third wearing portion. The fourth mesh hole unit is arranged on the first adjusting portion and the second adjusting portion. An aperture size of the third mesh hole unit is greater than an aperture size of the fourth mesh hole unit.

As an improvement of the present invention, an edge portion is formed at a lower end of the first wearing portion, and the edge portion is configured for fitting with a hairline of the head.

As an improvement of the present invention, the first wearing portion is an arc-shaped curved surface, and a lower end of the arc-shaped curved surface is bent inwards to form the edge portion.

As an improvement of the present invention, the second wearing portion, the first main body and the second main body are made of an elastic material.

As an improvement of the present invention, the first adjusting portion is positioned at a left auricle when the wig cap is worn on the head. The first body is provided with a first anchor point.

As an improvement of the present invention, the second adjusting portion is positioned at a right auricle when the wig cap is worn on the head. The second body is provided with a second anchor point.

The present invention has the following beneficial effects. The present invention provides a wig cap including a first wearing portion, a second wearing portion and an adjusting portion. The first wearing portion is worn on the front portion of the head. The second wearing portion is worn on the rear portion of the head and is connected to the first wearing portion. The adjusting portion is respectively connected to the first wearing portion and the second wearing portion. The adjusting portion is configured for adjusting the tightness of the wig cap worn on the head. Through the above structure, the first wearing portion is worn on the front portion of the user's head. The second wearing portion is worn on the rear portion of the user's head. The adjusting portion is adjusted according to a size of the user's head, so that the wig cap is attached to the user's head.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
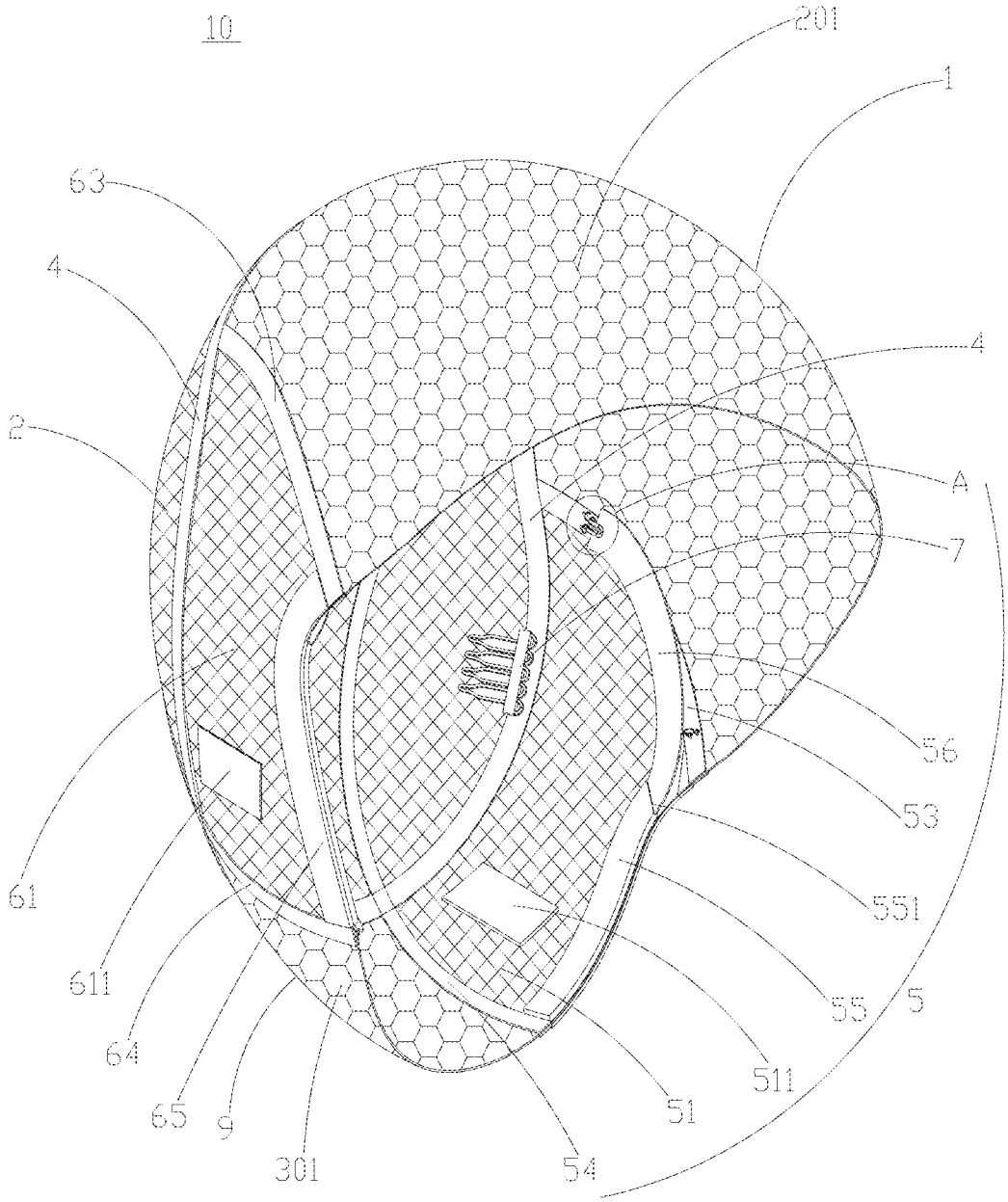
FIG. 1 is a structural schematic diagram of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
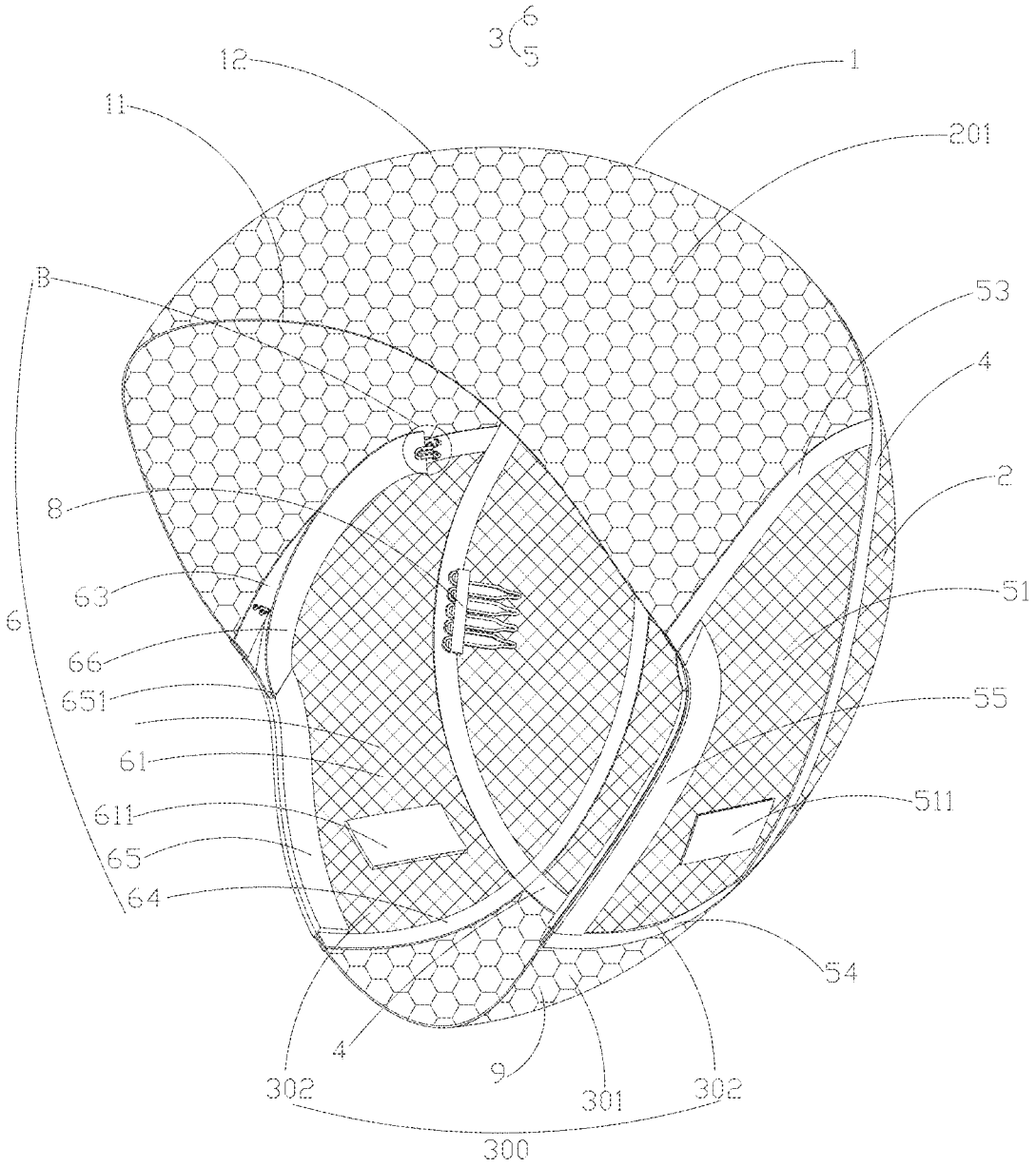
FIG. 2 is a structural schematic diagram of the present invention from another angle.
Figure 3:
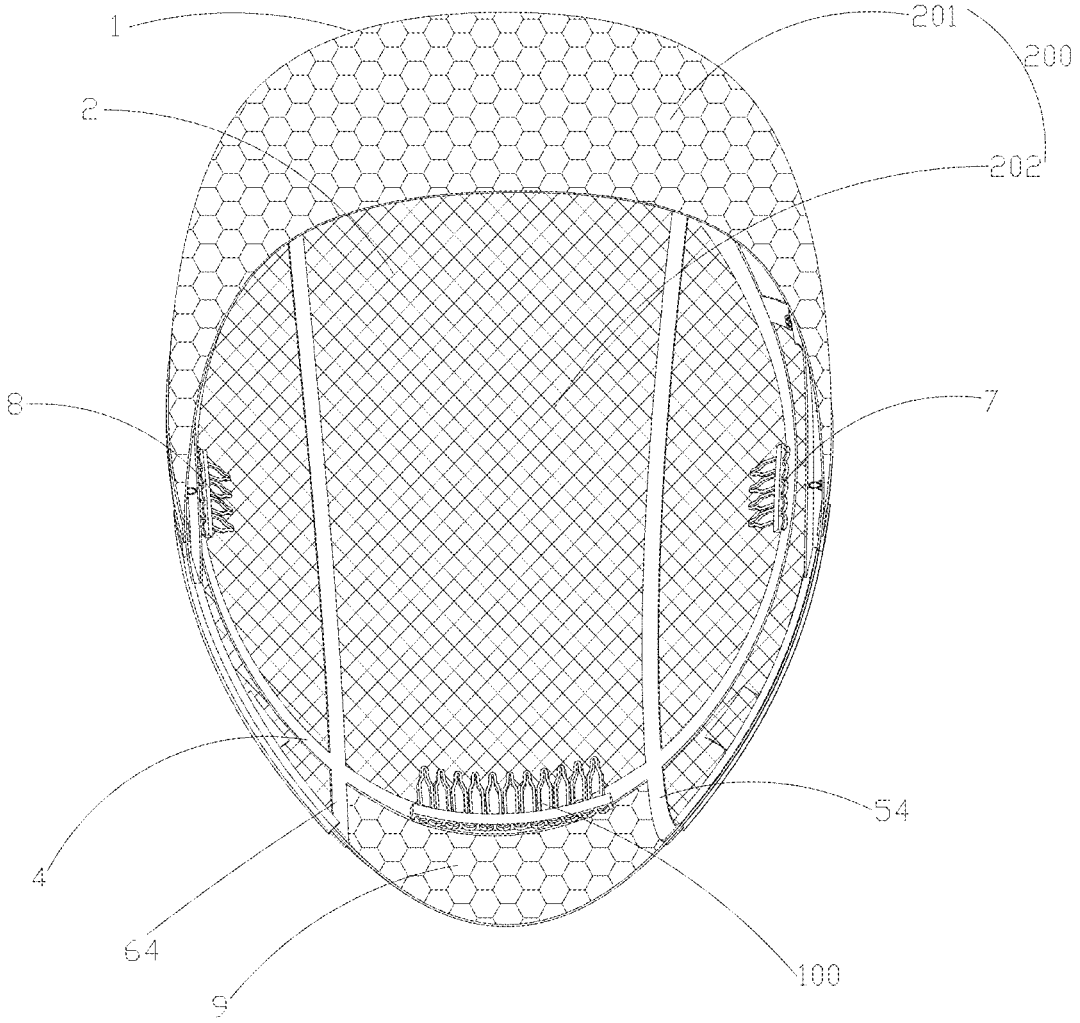
FIG. 3 is a structural schematic diagram of the present invention from another angle.
Figure 4:
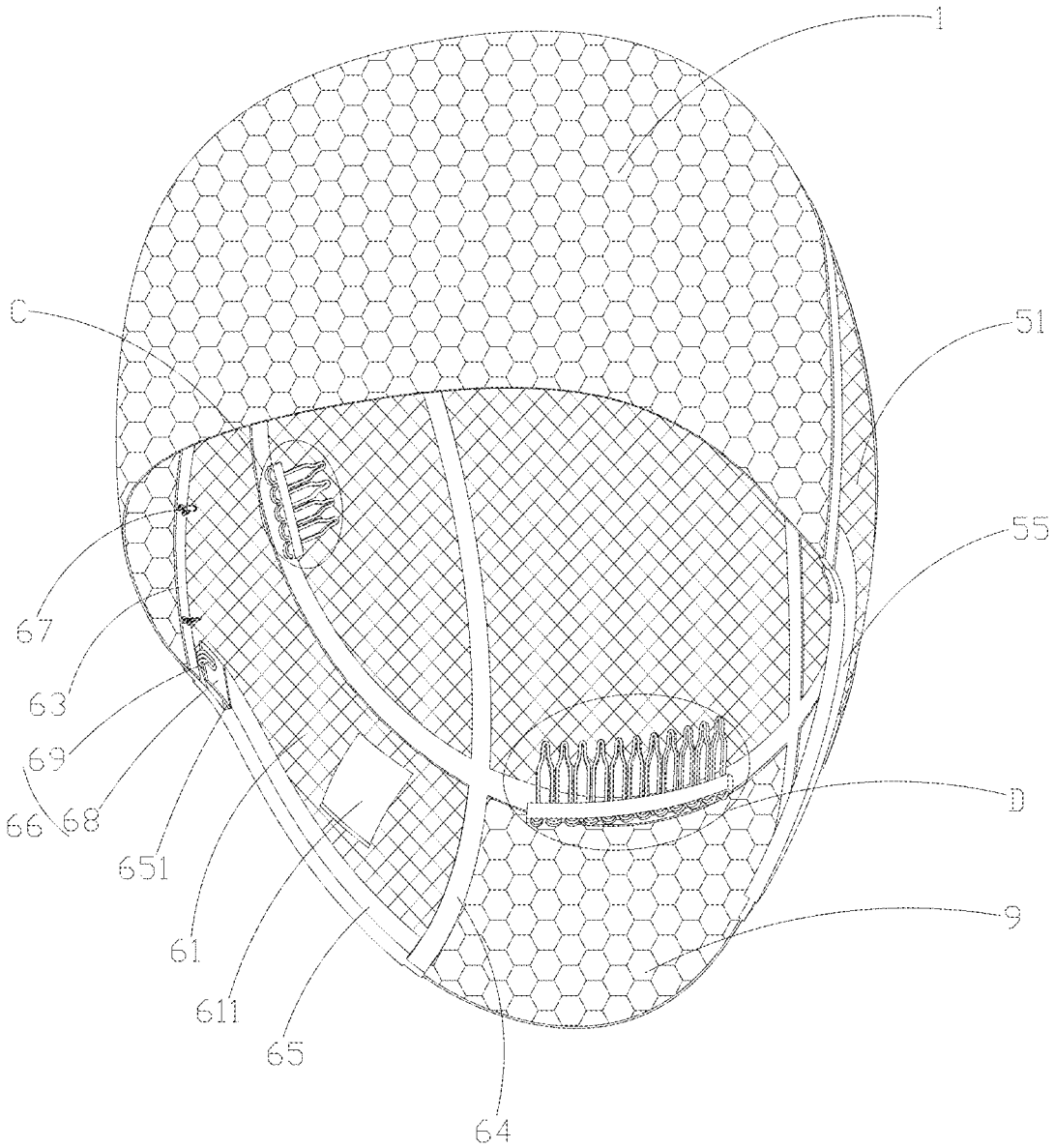
FIG. 4 is a structural schematic diagram of a second hook fastener not fastened to a second fastener according to the present invention.
Figure 5:
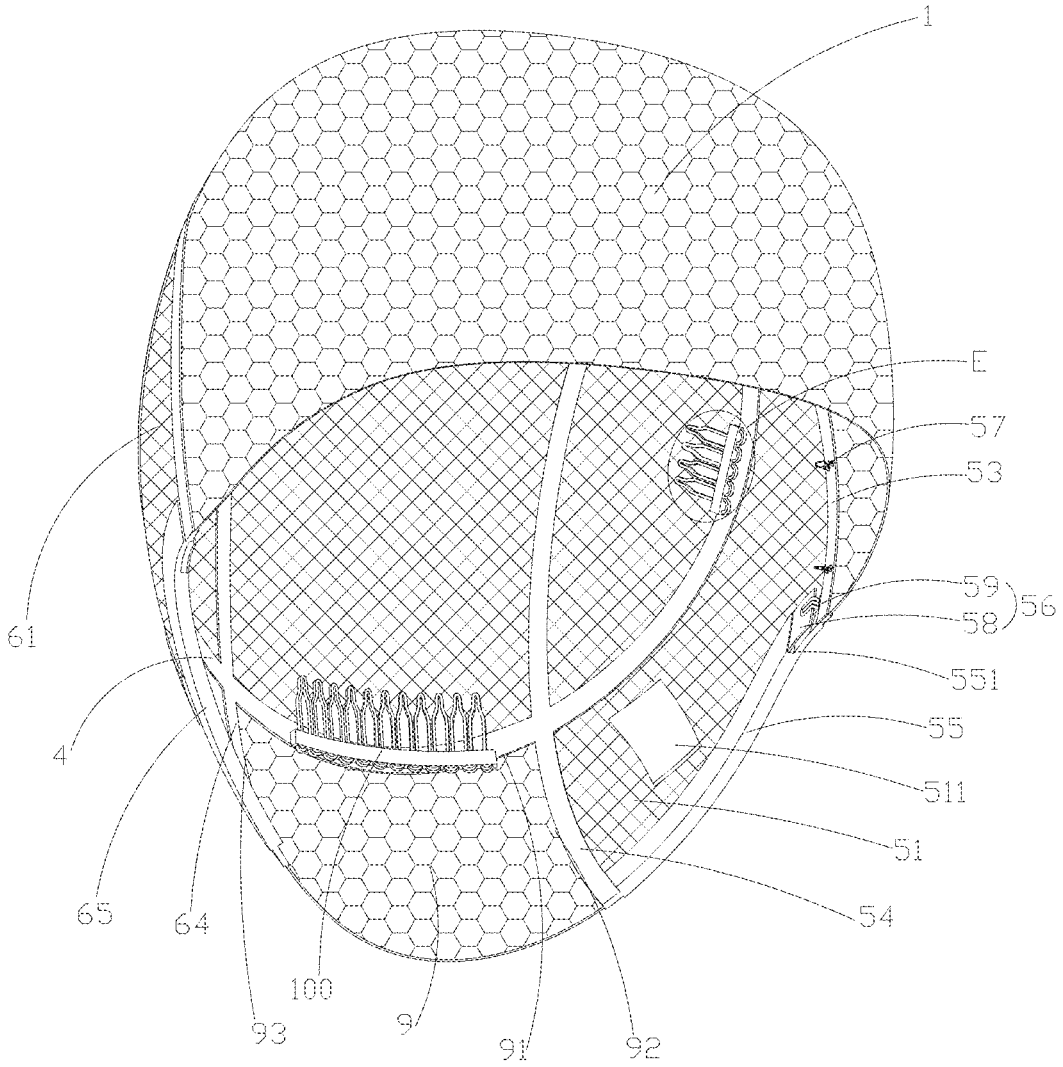
FIG. 5 is a structural schematic diagram of a first hook fastener not fastened to a first fastener according to the present disclosure.
Figure 6:
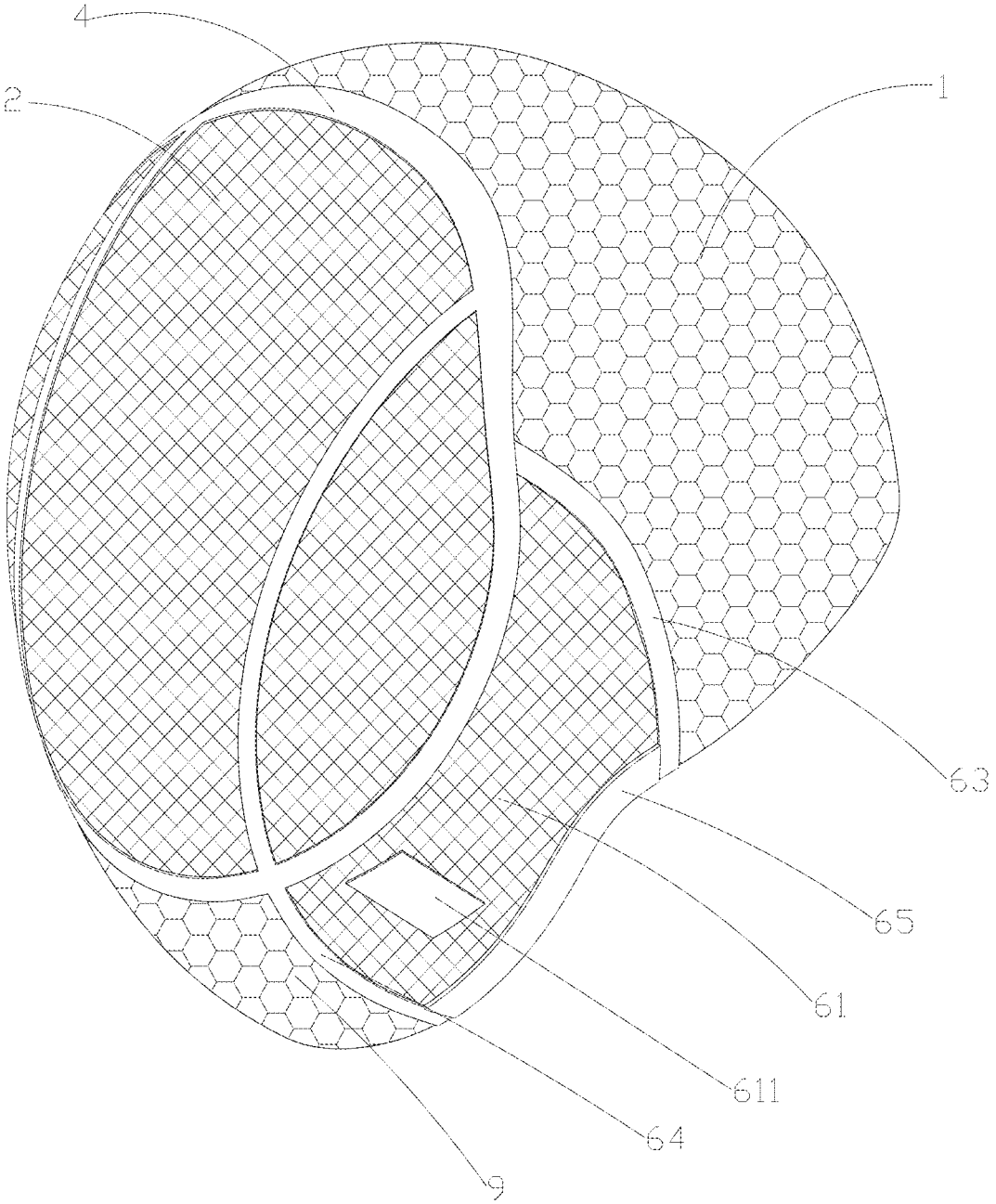
FIG. 6 is a structural schematic diagram of the present invention from still another angle.
Figure 7:
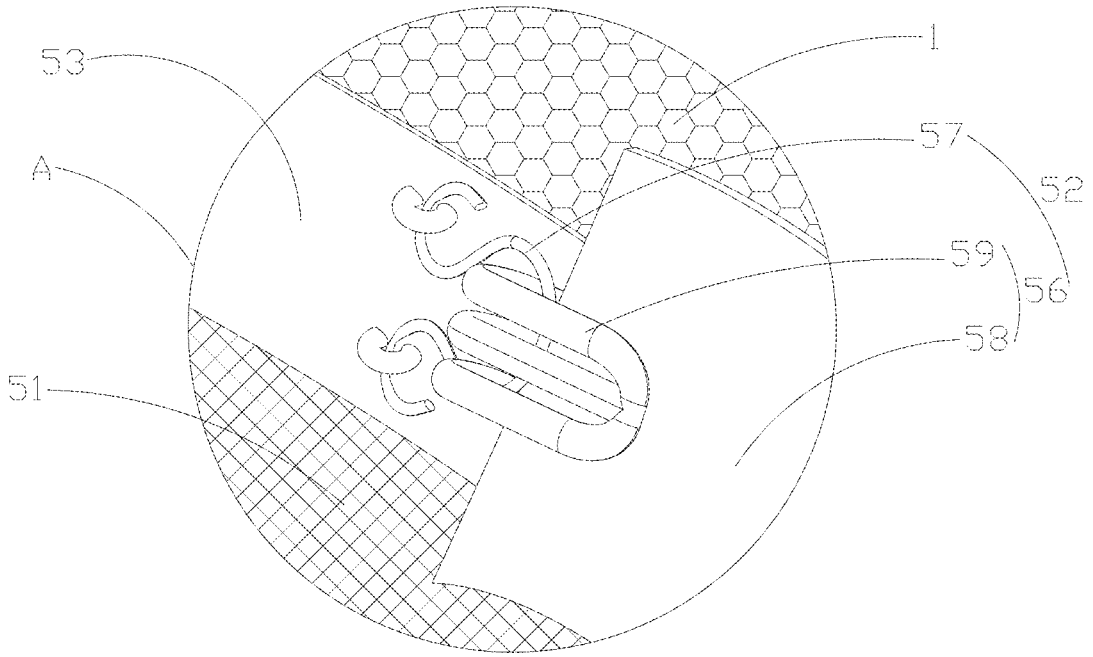
FIG. 7 is a structural schematic diagram of A in FIG. 1 of the present invention.
Figure 8:
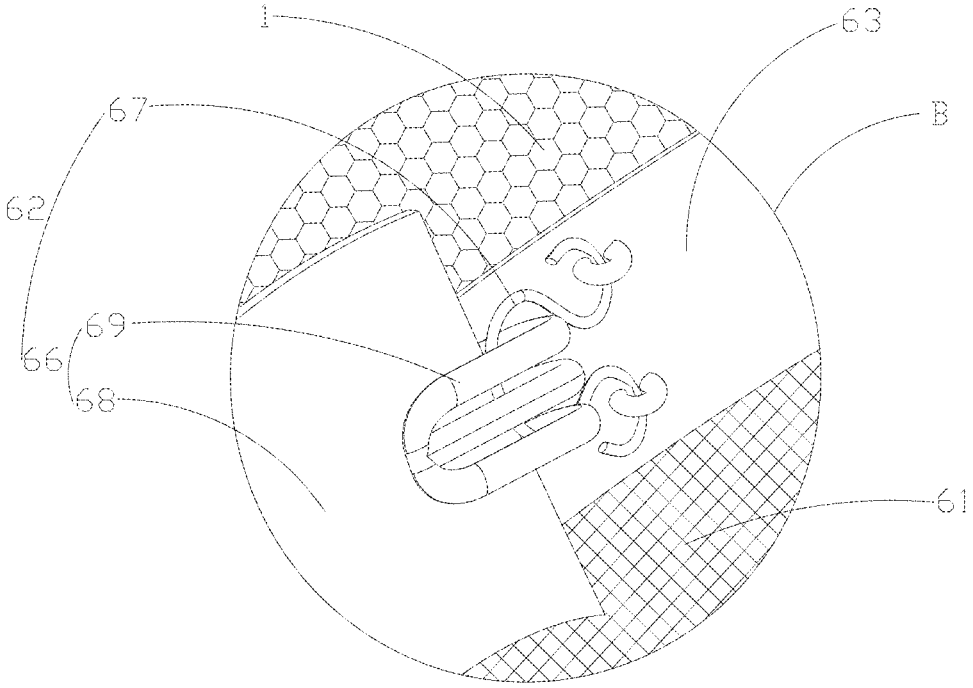
FIG. 8 is a structural schematic diagram of B in FIG. 2 of the present invention.
Figure 9:
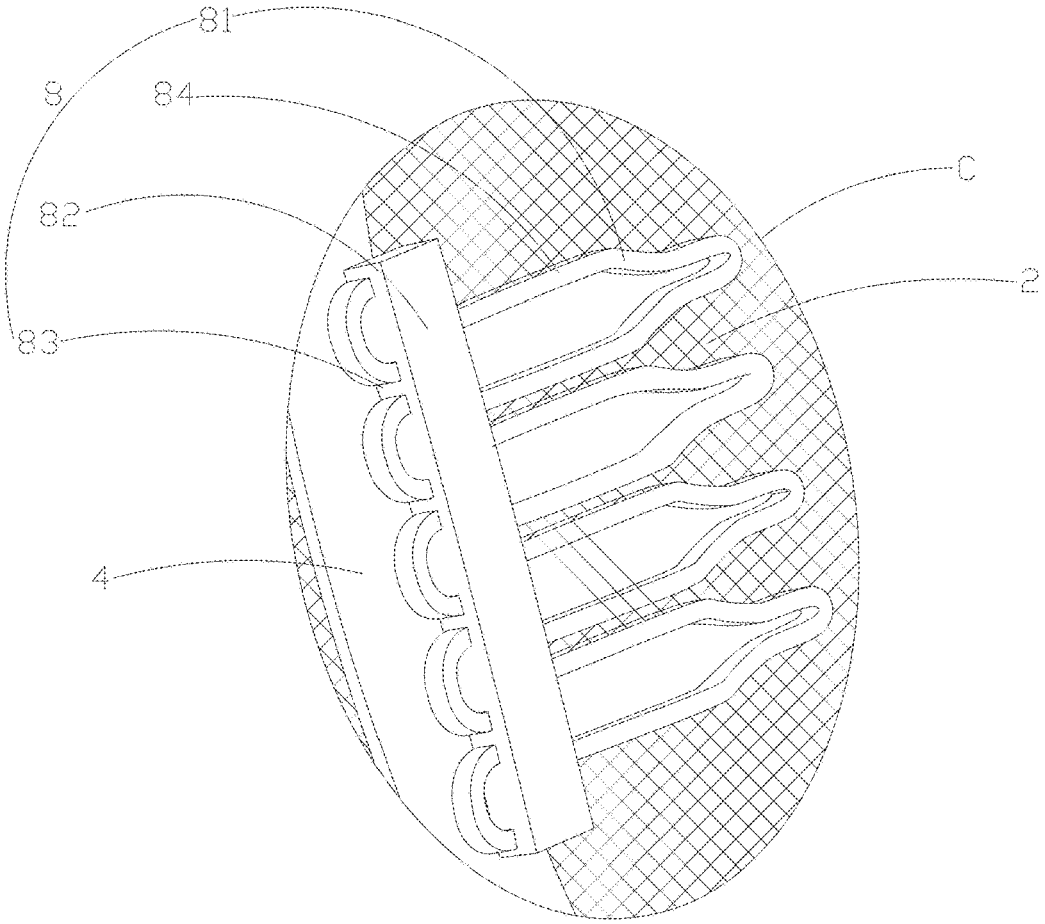
FIG. 9 is a structural schematic diagram of C in FIG. 4 of the present invention.
Figure 10:
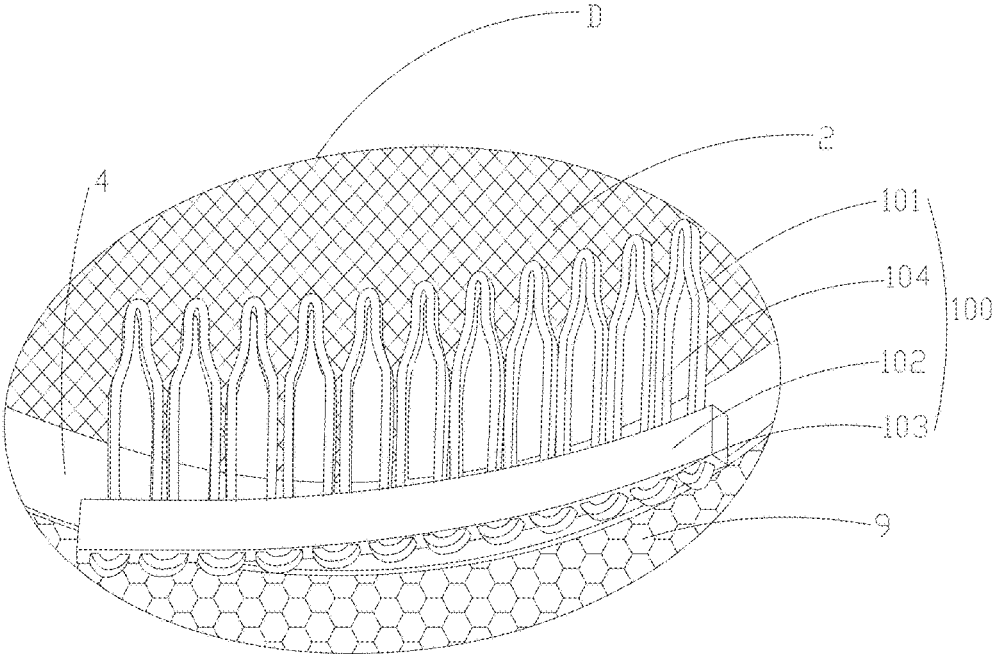
FIG. 10 is a structural schematic diagram of D in FIG. 4 of the present invention.
Figure 11:
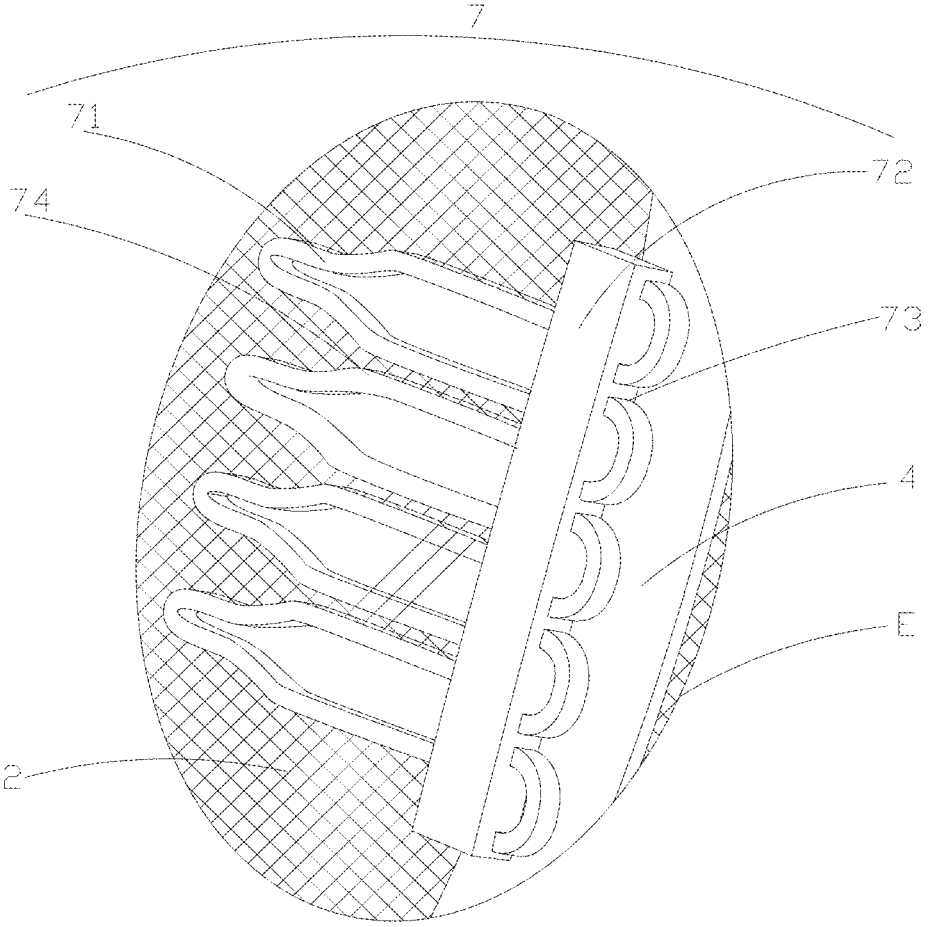
FIG. 11 is a structural schematic diagram of E in FIG. 5 of the present invention.

Referring to FIG. 1 to FIG. 11, a wig cap includes a first wearing portion 1, a second wearing portion 2 and an adjusting portion 3. The first wearing portion 1 is worn on a front portion of a head. The second wearing portion 2 is worn on a rear portion of the head and is connected to the first wearing portion 1. The adjusting portion 3 is respectively connected to the first wearing portion 1 and the second wearing portion 2. The adjusting portion 3 is configured for adjusting a tightness of the wig cap 10 worn on the head.

Through the above structure, the first wearing portion 1 is worn on the front portion of a user's head. The second wearing portion 2 is worn on the rear portion of the user's head. The adjusting portion 3 can be adjusted according to a size of the user's head, so that the wig cap 10 is attached to the user's head.

In the present embodiment, a lower edge of the second wearing portion 2 is provided with a first connecting strap 4. The first connecting strap 4 is arranged around the lower edge of the second wearing portion 2. The first wearing portion 1 is connected to the second wearing portion 2 via the first connecting strap 4. Through the above structure, the second wearing portion 2 is connected to the first wearing portion 1, a third wearing portion 9, a first adjusting portion 5 and a second adjusting portion 6 via the first connecting strap 4, so that the first wearing portion 1, the third wearing portion 9, the first adjusting portion 5 and the second adjusting portion 6 surround a periphery of the second wearing portion 2.

In the present embodiment, the adjusting portion 3 includes the first adjusting portion 5 and the second adjusting portion 6. The first adjusting portion 5 and the second adjusting portion 6 are symmetrical in position. The first adjusting portion 5 and the second adjusting portion 6 are respectively connected to the second wearing portion 2 via the first connecting strap 4. The first adjusting portion 5 includes a first main body 51 and a first adjusting structure 52. The first adjusting structure 52 is arranged on the first main body 51. The first main body 51 is provided with a second connecting strap 53. The first main body 51 is connected to the second wearing portion 2 via the first connecting strap 4. The first main body 51 is connected to the first wearing portion 1 through the second connecting strap 53. Through the above structure, two ends of the wig cap 10 can be adjusted through the first adjusting portion 5 and the second adjusting portion 6, so that the first wearing portion 1 and the second wearing portion 2 fit the user's head.

In the present embodiment, the first main body 51 is further provided with a third connecting strap 54. The third connecting strap 54 and the second connecting strap 53 are arranged opposite to each other. The third connecting strap 54 and the second connecting strap 53 are arranged on two sides of the first main body 51. The first main body 51 is provided with a first wearing cavity 55 between the second connecting strap 53 and the third connecting strap 54. The first wearing cavity 55 defines a first opening 551 at one end of the second connecting strap 53. The first adjusting structure 52 includes a first elastic band 56 and a plurality of first fasteners 57. The first elastic band 56 is fastened to the plurality of first fasteners 57. The plurality of first fasteners 57 are arranged sequentially from top to bottom on the second connecting strap 53. The first elastic band 56 includes a first band body 58 and a first hook fastener 59. A first end of the first band body 58 is arranged in the first wearing cavity 55 and is connected to an inner wall of the first wearing cavity 55. A second end of the first band body 58 is connected to the first hook fastener 59. The first hook fastener 59 is arranged outside the first wearing cavity 55. The first hook fastener 59 can be fastened to any one of the first fasteners 57. Through the above structure, the first hook fastener 59 moves with the first band body 58 when the first band body 58 is pulled out from the first wearing cavity 55. The first hook fastener 59 is fastened to the first fastener 57. Distances between each of the plurality of first fasteners 57 on the second connecting strap 53 and the first hook fastener 59 are inconsistent, enabling users to select the different first fasteners 57 to be fastened to the first hook fastener 59 according to their own head sizes, such that the wig cap 10 can fit different head shapes.

In the present embodiment, the second adjusting portion 6 includes a second main body 61 and a second adjusting structure 62. The second adjusting structure 62 is arranged on the second main body 61. The second main body 61 is provided with a fourth connecting strap 63. The second main body 61 is connected to the second wearing portion 2 via the first connecting strap 4. The second main body 61 is connected to the first wearing portion 1 via the fourth connecting strap 63. The second main body 61 is provided with a fifth connecting strap 64. The fifth connecting strap 64 and the fourth connecting strap 63 are arranged opposite to each other. The fifth connecting strap 64 and the fourth connecting strap 63 are arranged on two sides of the second main body 61. The second main body 61 is provided with a second wearing cavity 65 between the fourth connecting strap 63 and the fifth connecting strap 64. The second wearing cavity 65 defines a second opening 651 at one end of the fourth connecting strap 63. The second adjusting structure 62 includes a second elastic band 66 and a plurality of second fasteners 67. The second elastic band 66 is fastened to the plurality of second fasteners 67. The plurality of second fasteners 67 are arranged sequentially from top to bottom on the fourth connecting strap 63. The second elastic band 66 includes a second band body 68 and a second hook fastener 69. A first end of the second band body 68 is arranged in the second wearing cavity 65 and is connected to an inner wall of the second wearing cavity 65. A second end of the second band body 68 is connected to the second hook fastener 69. The second hook fastener 69 is arranged outside the second wearing cavity 65. The second hook fastener 69 can be fastened to any one of the second fasteners 67. Through the above structure, the second hook fastener 69 moves with the second band body 68 when the second band body 68 is pulled out from the second wearing cavity 65. The second hook fastener 69 is fastened to the second fastener 67. Distances between each of the plurality of second fasteners 67 on the fourth connecting strap 63 and the second hook fastener 69 are inconsistent, enabling users to select the different second fasteners 67 to be fastened to the second hook fastener 69 according to their own head sizes, such that the wig cap 10 can fit different head shapes.

In the present embodiment, the first connecting strap 4 is provided with a first inserting comb module 7 at the first main body 51. The first inserting comb module 7 includes a first inserting comb 71 and a plurality of first fixing members 72. The plurality of first fixing members 72 are sequentially arranged on the first connecting strap 4. Each first fixing member 72 defines a first through hole 73. The first inserting comb 71 includes a plurality of first comb teeth 74. One end of the first comb teeth 74 passes through the first through hole 73 and is inserted into the first fixing member 72. Through the above structure, the first inserting comb 71 is inserted into the first fixing member 72 and is clamped on the user's own hair. If the user does not need the first inserting comb 71, the first inserting comb 71 can be removed from the first fixing member 72.

In the present embodiment, the first connecting strap 4 is provided with a second inserting comb module 8 at the second main body 61. The second inserting comb module 8 includes a second inserting comb 81 and a plurality of second fixing members 82. The plurality of second fixing members 82 are sequentially arranged on the first connecting strap 4. Each second fixing member 82 defines a second through hole 83. The second inserting comb 81 includes a plurality of second comb teeth 84. One end of the second comb teeth 84 passes through the second through hole 83 and is inserted into the second fixing member 82. Through the structure above, the second inserting comb 81 is inserted into the second fixing member 82 and is clamped on the user's own hair. If the user does not need the second inserting comb 81, the second inserting comb 81 can be removed from the second fixing member 82.

In the present embodiment, the wig cap 10 further includes the third wearing portion 9. The third wearing portion 9 is positioned on one side of the second wearing portion 2. The third wearing portion 9 includes a first end 91, a second end 92 and a third end 93. The first end 91 of the third wearing portion 9 is connected to the first connecting strap 4. The second end 92 of the third wearing portion 9 is connected to the third connecting strap 54. The third end 93 of the third wearing portion 9 is connected to the fifth connecting strap 64. The first connecting strap 4 is provided with a third inserting comb module 100 at the third wearing portion 9. The third inserting comb module 100 includes a third inserting comb 101 and a plurality of third fixing members 102. The plurality of third fixing members 102 are sequentially arranged on the first connecting strap 4. Each third fixing member 102 defines a third through hole 103. The third inserting comb 101 includes a plurality of third comb teeth 104. One end of the third comb teeth 104 passes through the third through hole 103 and is inserted into the third fixing member 102. Through the above structure, the third inserting comb 101 is inserted into the third fixing member 102 and is clamped on the user's own hair. If the user does not need the third inserting comb 101, the third inserting comb 101 can be removed from the third fixing member 102.

In the present embodiment, the first wearing portion 1 and the second wearing portion 2 both define first mesh holes 200. The first mesh holes 200 include a first mesh hole unit 201 and a second mesh hole unit 202. The first mesh hole unit 201 is arranged on the first wearing portion 1. The second mesh hole unit 202 is arranged on the second wearing portion 2. An aperture size of the first mesh hole unit 201 is greater than an aperture size of the second mesh hole unit 202.

In the present embodiment, the first adjusting portion 5, the second adjusting portion 6, and the third wearing portion 9 all define second mesh holes 300. The second mesh holes 300 include a third mesh hole unit 301 and a fourth mesh hole unit 302. The third mesh hole unit 301 is provided on the third wearing portion 9. The fourth mesh hole unit 302 is provided on the first adjusting portion 5 and the second adjusting portion 6. An aperture size of the third mesh hole unit 301 is greater than an aperture size of the fourth mesh hole unit 302. Through the above structure, since the first wearing portion 1 is mainly attached to the front portion of the user's head, and the third wearing portion 9 is mainly attached to the rear portion of the user's head, the first mesh hole unit 201 and the third mesh hole unit 301 of the larger aperture can provide better air permeability, so as to improve the wearing comfort of the wig cap 10.

In the present embodiment, an edge portion 11 is formed at a lower end of the first wearing portion 1, and the edge portion 11 is configured for fitting with the hairline of the head. The first wearing portion 1 is an arc-shaped curved surface 12, and a lower end of the arc-shaped curved surface 12 is bent inwardly to form the edge portion 11. Through the above structure, the wig cap 10 is moved to align the edge portion 11 with the hairline of the user's head, so as to hide the wig cap 10. When the wig cap 10 is worn, it is generally difficult to align the edge portion 11 with the hairline in a single pass. At this time, the wig cap 10 can be moved appropriately to align the edge portion 11 with the hairline. After the edge portion 11 is aligned with the hairline, in order to make the edge portion 11 fit more closely with the hairline, the wig cap 10 can be pulled to further tighten the edge portion 11 at the hairline.

In the present embodiment, the second wearing portion 2, the first main body 51 and the second main body 61 are made of an elastic material. Specifically, the second wearing portion 2, the first main body 51 and the second main body 61 can be made of the elastic materials such as lace and elastic nylon, which are soft and warm.

In the present embodiment, the first adjusting portion 5 is positioned at a left auricle when the wig cap 10 is worn the head, and the first main body 51 is provided with a first anchor point 511. The second adjusting portion 6 is positioned at a right auricle when the wig cap 10 is worn on the head, and the second main body 61 is provided with a second anchor point 611. Through the above structure, the first anchor point 511 and the second anchor point 611 anchor at two ears of the user's head, facilitating the user to adjust the position of the wig cap 10. In this way, the wig cap 10 will not shift, and thus, it is convenient for the user to use.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

The invention claimed is:

1. A wig cap, comprising:

a first wearing portion made of a mesh material and adapted to be worn on a front portion of a head of a user;

a second wearing portion made of a mesh material and adapted to be worn on a rear portion of the head and connected to the first wearing portion;

an adjusting portion, the adjusting portion being respectively connected to the first wearing portion and the second wearing portion, wherein the adjusting portion is configured for adjusting a tightness of the wig cap worn on the head;

wherein a first connecting strap is arranged at a lower edge of the second wearing portion and between adjoining edges of the first and second wearing portions such that the first wearing portion is connected to the second wearing portion via the first connecting strap;

wherein the adjusting portion comprises a first adjusting portion and a second adjusting portion;

the first adjusting portion comprises a first main body and a first adjusting structure, and the first adjusting structure is arranged on the first main body; the first main body is provided with a second connecting strap and a third connecting strap opposite the second connecting strap, where the third connecting strap and the second connecting strap are arranged on two sides of the first main body; a first wearing cavity is defined between the second and third connecting straps, where the first wearing cavity provides a first opening at one end thereof adjacent to the second connecting strap, the first main body is connected to the second wearing portion through the first connecting strap, and the first main body is connected to the first wearing portion through the second connecting strap;

wherein the first adjusting structure comprises a first elastic band and a plurality of first fasteners, and the first elastic band is fastened to the plurality of first fasteners; the plurality of first fasteners are sequentially arranged on the second connecting strap from top to bottom, the first elastic band comprises a first band body and a first hook fastener, a first end of the first band body is arranged in the first wearing cavity and is connected to an inner wall of the first wearing cavity, a second end of the first band body is connected to the first hook fastener, the first hook fastener is arranged outside the first wearing cavity, and the first hook fastener can be fastened to any one of the first fasteners; and the second adjusting portion comprises a second main body and a second adjusting structure, and the second adjusting structure is arranged on the second main body; the second main body is provided with a fourth connecting strap and a fifth connecting strap opposite the fourth connecting strap, a second wearing cavity is defined between the fourth and fifth connecting straps, where the second wearing cavity provides a second opening at one end thereof adjacent to the fourth connecting strap, the second main body is connected to the second wearing portion through the first connecting strap, and the second main body is connected to the first wearing portion through the fourth connecting strap;

wherein the second adjusting structure comprises a second elastic band and a plurality of second fasteners, and the second elastic band is fastened to the plurality of second fasteners; the plurality of second fasteners are sequentially arranged on the fourth connecting strap from top to bottom, the second elastic band comprises a second band body and a second hook fastener, and the second hook fastener is fastened to any one of the second fasteners.

2. The wig cap according to claim 1, wherein the first adjusting portion is spatially symmetric to the second adjusting portion.

3. The wig cap according to claim 1, wherein a first end of the second band body is arranged in the second wearing cavity and is connected to an inner wall of the second wearing cavity, a second end of the second band body is connected to the second hook fastener, and the second hook fastener is arranged outside the second wearing cavity.

4. The wig cap according to claim 2, wherein the first connecting strap is provided with a first inserting comb module at the first main body, the first inserting comb module comprises a first inserting comb and a plurality of first fixing members, the plurality of first fixing members are sequentially arranged on the first connecting strap, each first fixing member defines a first through hole, the first inserting comb comprises a plurality of first comb teeth, one end of the first comb teeth passes through the first through hole and is inserted into the first fixing member.

5. The wig cap according to claim 4, wherein the first connecting strap is provided with a second inserting comb module at the second main body, the second inserting comb module comprises a second inserting comb and a plurality of second fixing members, the plurality of second fixing members are sequentially arranged on the first connecting strap, each second fixing member defines a second through hole, the second inserting comb comprises a plurality of second comb teeth, one end of the second comb teeth passes through the second through hole and is inserted into the second fixing member.

6. The wig cap according to claim 1, wherein the wig cap further comprises a third wearing portion, and the third wearing portion is positioned on one side of the second wearing portion; the third wearing portion comprises a first end, a second end and a third end, the first end of the third wearing portion is connected to the first connecting strap, the second end of the third wearing portion is connected to the third connecting strap, and the third end of the third wearing portion is connected to the fifth connecting strap.

7. The wig cap according to claim 5, wherein a third inserting comb module is provided at the third wearing portion on the first connecting strap, the third inserting comb module comprises a third inserting comb and a plurality of third fixing members, the plurality of third fixing members are sequentially arranged on the first connecting strap, a third through hole is defined on each third fixing member, the third inserting comb comprises a plurality of third comb teeth, one end of the third comb teeth passes through the third through hole and is inserted into the third fixing member.

8. The wig cap according to claim 1, wherein the first wearing portion and the second wearing portion both define first mesh holes, the first mesh holes comprise a first mesh hole unit and a second mesh hole unit, the first mesh hole unit is arranged on the first wearing portion, the second mesh hole unit is arranged on the second wearing portion, and an aperture size of the first mesh hole unit is greater than an aperture size of the second mesh hole unit.

9. The wig cap according to claim 6, wherein the first adjusting portion, the second adjusting portion and the third wearing portion all define second mesh holes, the second mesh holes comprises a third mesh hole unit and a fourth mesh hole unit, the third mesh hole unit is arranged on the third wearing portion, the fourth mesh hole unit is arranged on the first adjusting portion and the second adjusting portion, and an aperture size of the third mesh hole unit is greater than an aperture size of the fourth mesh hole unit.

10. The wig cap according to claim 1, wherein an edge portion is formed at a lower end of the first wearing portion, and the edge portion is configured for fitting with a hairline of the head.

11. The wig cap according to claim 10, wherein the first wearing portion is an arc-shaped curved surface, and a lower end of the arc-shaped curved surface is bent inwards to form the edge portion.

12. The wig cap according to claim 1, wherein the second wearing portion, the first main body and the second main body are all made of an elastic material.

13. The wig cap according to claim 2, wherein the first adjusting portion is positioned at a left auricle when the wig cap is worn the head, and the first main body is provided with a first anchor point.

14. A wig cap, comprising:

a first wearing portion made of a mesh material and adapted to be worn on a front portion of a head of a user;

a second wearing portion made of a mesh material and adapted to be worn on a rear portion of the head, where the second wearing portion is connected to the first wearing portion via a first connecting strap extending along the perimeter of the second wearing portion; and first and second adjusting portions, each of the first and second adjusting portions comprising:

a main body of mesh material having a first edge coupled to a side of the second wearing portion via the first connecting strap, a second edge opposite the first edge, and opposing third and fourth edges disposed between the first and second edges, where the second edge defines a portion of a peripheral edge of the wig cap;

a second connecting strap extending over the third edge and connecting the main body to the first wearing portion, where one end of the second connecting strap is connected to the first connecting strap and an opposing end of the second connecting strap is disposed at the peripheral edge of the wig cap;

a plurality of fasteners sequentially arranged along the second connecting strap, a third connecting strap arranged on the fourth edge of the first main body, where one end of the third connecting strap is connected to the first connecting strap and an opposing end of the third connecting strap is disposed at the peripheral edge of the wig cap;

an elastic band arranged on the second edge of the main body between the second and third connecting straps, where the elastic band has a first fixed end adjacent the fourth edge and a second free end with a fastening element which releasably engages a selected one of the plurality of fasteners on the second connecting strap to adjust the tightness of the wig cap when worn on the head;

wherein the first and second adjusting portions are spatially symmetric, such that when worn the first adjusting portion is positioned adjacent the user's left ear and the second adjusting portion is positioned adjacent the user's right ear.

15. The wig cap according to claim 14, wherein the first wearing portion and the second wearing portion both define first mesh holes, the first mesh holes comprise a first mesh hole unit and a second mesh hole unit, the first mesh hole unit is arranged on the first wearing portion, the second mesh hole unit is arranged on the second wearing portion, and an aperture size of the first mesh hole unit is greater than an aperture size of the second mesh hole unit.

16. A wig cap, comprising:

a first wearing portion made of a mesh material and adapted to be worn on a front portion of a head of a user;

a second wearing portion made of a mesh material and adapted to be worn on a rear portion of the head, where the second wearing portion is connected to the first wearing portion via a first connecting strap extending along the perimeter of the second wearing portion; and an adjusting portion, the adjusting portion being respectively connected to the first wearing portion and the second wearing portion, wherein the adjusting portion is configured for adjusting a tightness of the wig cap worn on the head;

wherein the first wearing portion is connected to the second wearing portion via the first connecting strap;

wherein the adjusting portion comprises a first adjusting portion and a second adjusting portion, and the first adjusting portion is spatially symmetric to the second adjusting portion such that when worn the first adjusting portion is positioned adjacent to the user's left ear and the second adjusting portion is positioned adjacent to the user's right ear; the first adjusting portion and the second adjusting portion are respectively connected to the second wearing portion via the first connecting strap;

wherein the first adjusting portion comprises a first main body and a first adjusting structure, and the first adjusting structure is arranged on the first main body; the first main body is provided with a second connecting strap, the first main body is connected to the second wearing portion through the first connecting strap, and the first main body is connected to the first wearing portion through the second connecting strap;

wherein the first main body is further provided with a third connecting strap, the third connecting strap is arranged opposite to the second connecting strap, and the third connecting strap and the second connecting strap are arranged on two sides of the first main body; a first wearing cavity is defined on the first main body between the second connecting strap and the third connecting strap, and the first wearing cavity defines a first opening at one end adjacent to the second connecting strap;

wherein the first adjusting structure comprises a first elastic band and a plurality of first fasteners, and the first elastic band is fastened to the plurality of first fasteners; the plurality of first fasteners are sequentially arranged on the second connecting strap from top to bottom, the first elastic band comprises a first band body and a first hook fastener, a first end of the first band body is arranged in the first wearing cavity and is connected to an inner wall of the first wearing cavity, a second end of the first band body is connected to the first hook fastener, the first hook fastener is arranged outside the first wearing cavity, and the first hook fastener can be fastened to any one of the first fasteners;

wherein the second adjusting portion comprises a second main body and a second adjusting structure, and the second adjusting structure is arranged on the second main body; the second main body is provided with a fourth connecting strap, the second main body is connected to the second wearing portion through the first connecting strap, and the second main body is connected to the first wearing portion through the fourth connecting strap;

wherein the second main body is further provided with a fifth connecting strap, and the fifth connecting strap and the fourth connecting strap are arranged opposite to each other, the fifth connecting strap and the fourth connecting strap are arranged on two sides of the second main body; the second main body defines a second wearing cavity between the fourth connecting strap and the fifth connecting strap, and a second opening is defined on the second wearing cavity at one end of the fourth connecting strap;

wherein the second adjusting structure comprises a second elastic band and a plurality of second fasteners, and the second elastic band is fastened to the plurality of second fasteners; the plurality of second fasteners are sequentially arranged on the fourth connecting strap from top to bottom, the second elastic band comprises a second band body and a second hook fastener, a first end of the second band body is arranged in the second wearing cavity and is connected to an inner wall of the second wearing cavity, a second end of the second band body is connected to the second hook fastener, the second hook fastener is arranged outside the second wearing cavity, and the second hook fastener is fastened to any one of the second fasteners;

wherein distances between each of the plurality of first fasteners on the second connecting strap and the first hook fastener are inconsistent; distances between each of the plurality of second fasteners on the fourth connecting strap and the second hook fastener are inconsistent.

* * * * *